US005855673A

United States Patent [19]

Dehn

[11] Patent Number: 5,855,673

[45] Date of Patent: Jan. 5, 1999

[54] APPARATUS FOR COATING EDGES

[76] Inventor: David L. Dehn, 723 Parkland Dr., Rochester Hills, Mich. 48307

[21] Appl. No.: 730,825

[22] Filed: Oct. 17, 1996

[51] Int. Cl.[6] ..... B05C 11/00

[52] U.S. Cl. ..... 118/264; 118/266; 118/269; 118/300; 427/284

[58] Field of Search ..... 118/264, 266, 118/269, 300; 427/284

[56] References Cited

U.S. PATENT DOCUMENTS

| | | | |
|---|---|---|---|
| 2,237,429 | 4/1941 | Harrington . | |
| 3,756,196 | 9/1973 | Furuuchi et al. . | |
| 4,660,501 | 4/1987 | Nagata et al. . | |
| 4,712,507 | 12/1987 | Helling . | |
| 4,790,259 | 12/1988 | Morris et al. . | |
| 4,995,934 | 2/1991 | Janatka | 118/264 |
| 5,012,758 | 5/1991 | Kunzler | 118/264 |
| 5,041,150 | 8/1991 | Grundy et al. . | |
| 5,083,525 | 1/1992 | Riera . | |
| 5,085,169 | 2/1992 | Okuda et al. | 118/264 |
| 5,131,349 | 7/1992 | Keller et al. . | |
| 5,316,581 | 5/1994 | Stanizewski | 118/264 |
| 5,354,379 | 10/1994 | Milbourn et al. | 118/264 |
| 5,360,645 | 11/1994 | Devries . | |
| 5,370,905 | 12/1994 | Varga et al. . | |
| 5,456,753 | 10/1995 | Kuribayashi et al. . | |

*Primary Examiner*—Peter Chin
*Assistant Examiner*—Michael P. Colaianni
*Attorney, Agent, or Firm*—John R. Benefiel

[57] ABSTRACT

An apparatus for wipe coating a perimeter edge of a panel part as well as simultaneous sections of either or both surfaces adjacent the perimeter edge, in which a wiper strip is advanced into a space between two movable guide blocks and past one or more deflector elements. When the panel part is inserted into the space, a shoulder is formed in the wiper strip to create contact with both a side surface and the perimeter edge, enabling coating of both simultaneously as the perimeter of the panel part is drawn through the space and in contact with the wiper strip. The deflector element can also be movably mounted to allow a variable depth of the side surface to be coated. Two wiper strips can also be used to wipe both sides of the panel part.

8 Claims, 7 Drawing Sheets

APPARATUS FOR COATING EDGES

BACKGROUND OF THE INVENTION

This invention concerns application of liquid coating onto the edges of a workpiece, such as a primer onto the edges of a windshield prior to adhesively molding a seal to the windshields or to and other automobile glazing panels.

A commonly practiced technique is to saturate felt wiping strips with the primer coating and pass the edge of the glazing panel against the felt strip to coat the side surfaces of the panel adjacent its perimeter. This is often done with a robot manipulator handling the glazing panel.

Such wiping technique is effective compared with spray coating, as overspray from spray coating wastes material and presents maintenance problems, and uniform application is more difficult.

Recent trends have resulted in a requirement to coat the perimeter edge as well as one or both sides of the glass along a strip adjacent the perimeter edge.

Heretofore, such perimeter edge coating when done simultaneously with side surfaces has only been possible with spray applications of the coatings, such as described in U.S. Pat. No. 5,360,645, issued on Nov. 1, 1994 for an "Apparatus and Method for Coating a Material Onto a Planar Substrate". As noted, spray coating has disadvantages.

Accordingly, it is an object of the present invention to provide an apparatus and process for simultaneously wipe coating a perimeter edge and one or both adjacent side surfaces of a panel.

SUMMARY OF THE INVENTION

This object and others, which will be understood upon a reading of the following specification and claims, are achieved by dispensing a saturated strip between a pair of fixture blocks which are each mounted for compliant spreading movement as by sliding apart against a resistance established by the application of a regulated air pressure so as to tend to move the blocks towards each other.

The strip is then deflected inwardly by being passed over a deflector element which is located below an upper region of the fixture blocks and aligned with the space between the blocks through which the strips enters. The deflector element creates an offset or step in the saturated strip when the edge of a panel is pushed down between the fixture blocks on one side of the strip. The strip wraps around one of the fixture blocks in being passed into the space between the fixture blocks.

When the panel part is swept over the strip, the perimeter edge surface wipes across the strip offset so formed to be wipe-coated, while simultaneously the side surface is also coated for the distance that the strip extends inward from the perimeter edge.

This side wipe distance cam be made variable by mounting the deflector element for compliance in the direction in which the part panel is inserted between the fixture blocks. This allows the offset to be located at a variable distance from the point where the strip passes between the fixture blocks by merely advancing the part edge a lesser or greater distance into this space, forcing the deflector element to a predetermined position. Thus, the coating area can be varied as desired by simply varying the depth to which the part panel is inserted.

Two coating strips can be employed for coating opposite side surfaces by deploying respective deflector elements to deflect each strip to form a pair of offsets, both strips then acting to coat a portion of the perimeter edge.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
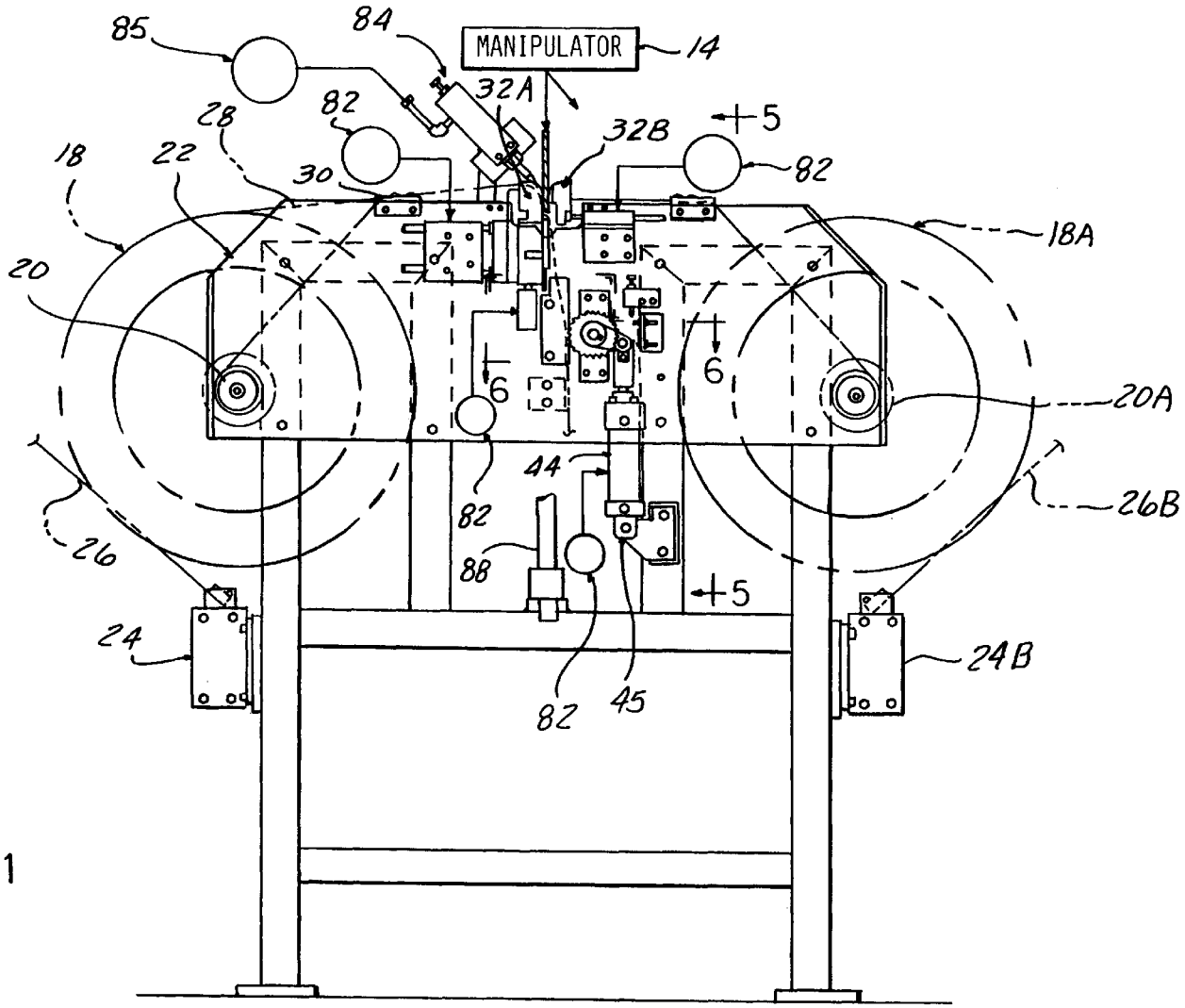
FIG. 1 is a cross-sectional view of a first embodiment of the apparatus of the present invention.
Figure 1A:
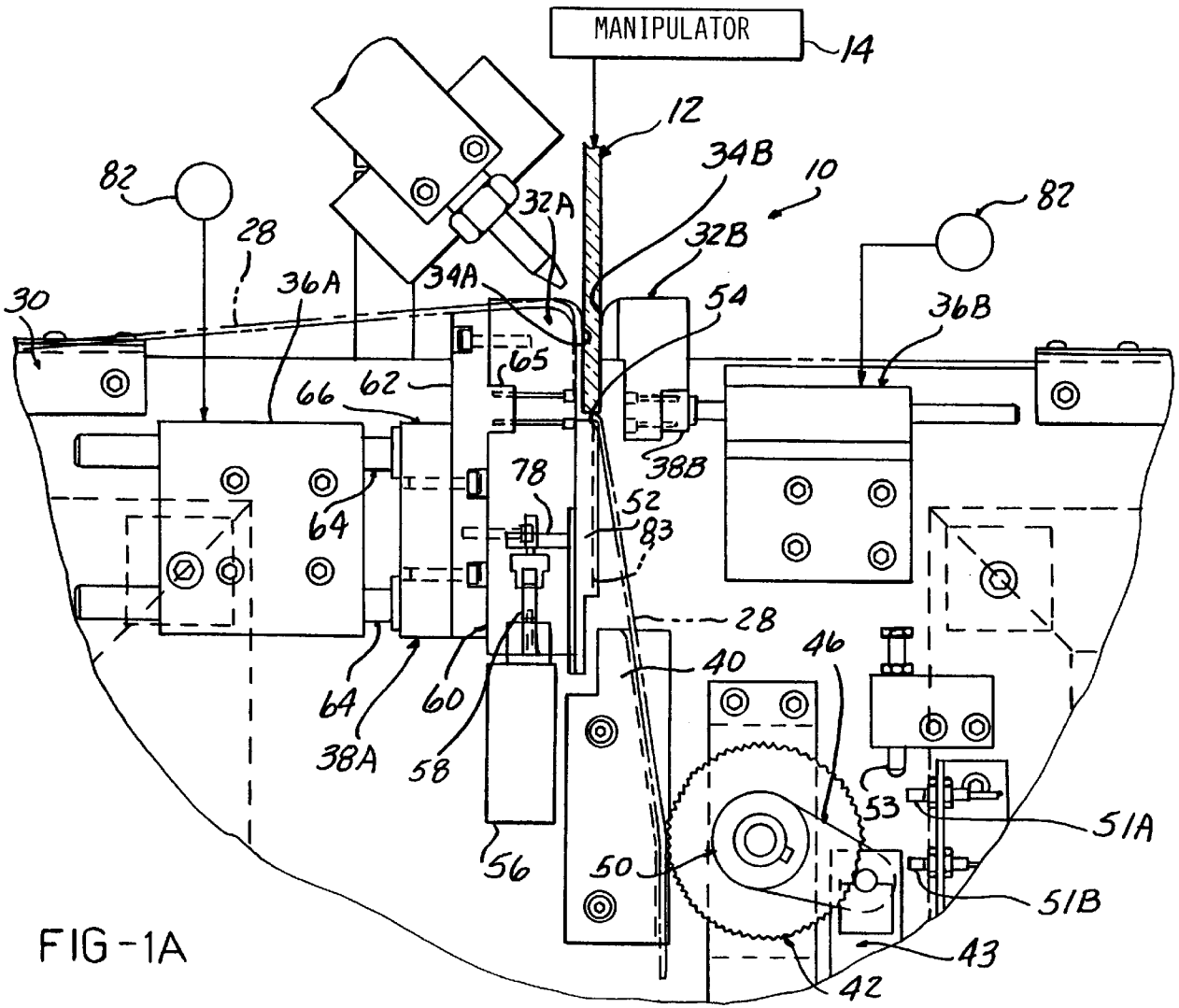
FIG. 1A is an enlarged fragmentary front elevational view of a first embodiment of the apparatus of the present invention.
Figure 2:
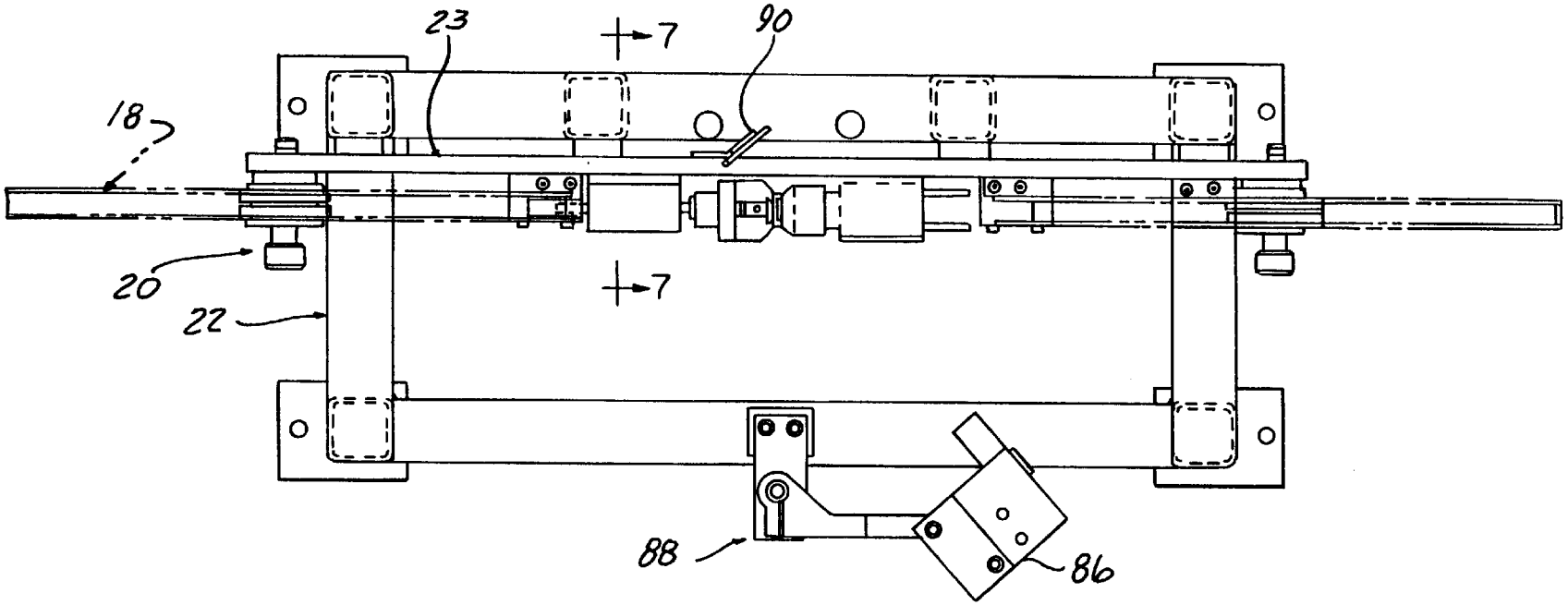
FIG. 2 is a plan view of the apparatus shown in FIG. 1.

Referring to FIGS. 1 and 1A, a coating apparatus 10 according to the present invention is shown, which is intended for use in coating the perimeter edge and one adjacent side surface of a glazing panel part 12 for an automobile, such as a windshield, backlight, or side panel, for example.

The apparatus 10 is to be used in conjunction with a manipulator 14 such as an industrial robot part handler which is capable of grasping a part panel 12, inserting it edgewise into the apparatus 10 and sweeping successive portions of the entire perimeter of the part 12 through the apparatus so as to wipe coat the perimeter edge and one side surface thereof adjacent the perimeter edge.

The wipe coating is carried out by a coating absorbent compressible strip 28, typically felt, which is fed off a supply roll 18 supported on a reel 20 mounted on a machine frame 22. A spare roll 18A can be stored on a reel 20A mounted on the opposite side of the frame 22. A limit switch 24 and feeler arm 26 monitor the available supply of felt material wiper strip 28. When the spare roll 18A is used to feed a second strip 28B (FIG. 9), a second limit switch 24B and feeler arm 26B are activated.

The strip 28 is fed off the roll 18 and across a guide 30, mounted to the frame 22, which has a recess to receive the strip 28 to guide the strip 28. The strip 28 is then passed between a pair of floating, movable guide blocks 32A, 32B, with the strip 28 wrapped around a curved surface in entering the space between the blocks 32A, 32B, guide block 30A also having a recess to receive the strip 28.

Each of the guide blocks 32A, 32B is constructed of a low friction, chemical-resistant material such as Teflon™, and is mounted to be movable along a horizontal direction, to allow respective facing surfaces 34A, 34B to be spread apart to allow entrance of the strip 28 therebetween.

At the same time, the guide blocks 32A, 32B are urged to move together exerting a pressure sufficient to cause coating of the panel part 12 by rubbing contact with the strip 28.

This is accomplished by a pair of air pressure operated slides 36A, 36B mounted to the frame 22, each having a guide block 32A, 32B attached to an output member 38A, 38B of a respective slide 36A, 36B. Moderate air pressure urges the guide blocks 32A, 32B in a direction tending to move the facing surfaces 34A, 34B together.

Slides 36A, 36B are of a commercially available type, such as the "Series S" slides sold under the PHD trademark.

Figure 5:
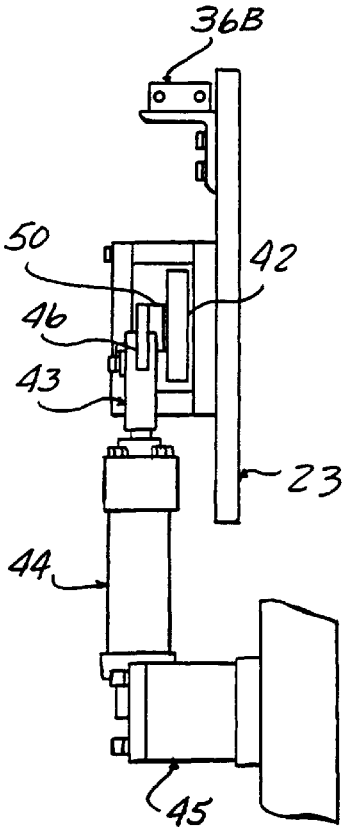
FIG. 5 is a view of the apparatus of FIG. 1 from the direction of arrows 5—5 in FIG. 1.
Figure 4:
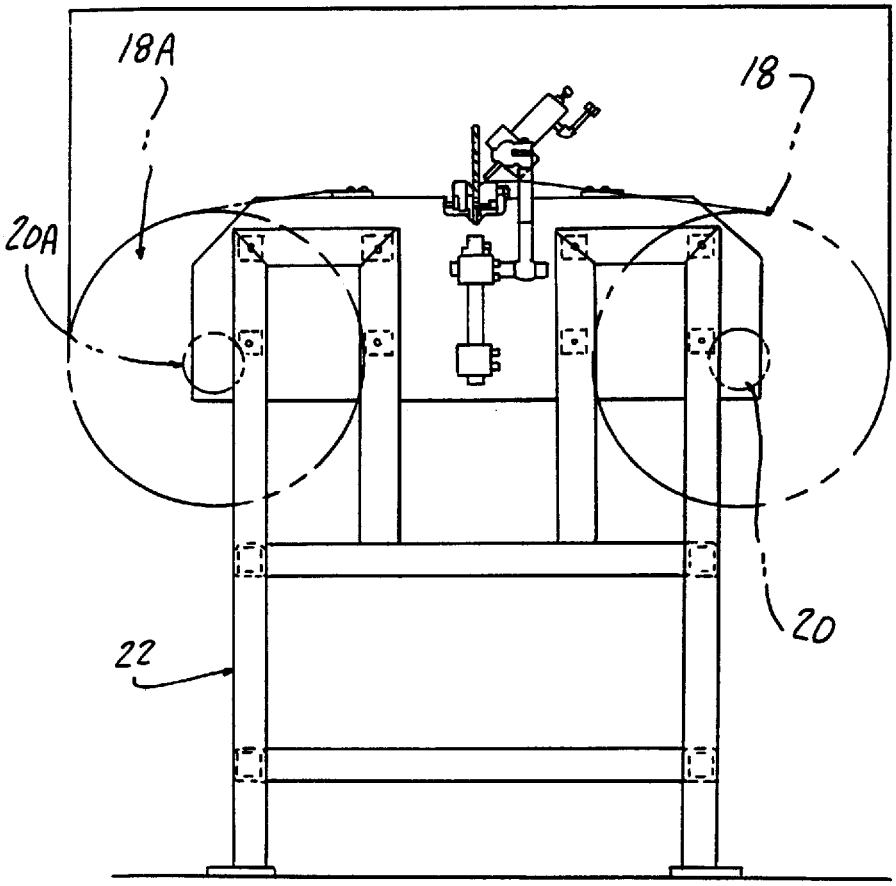
FIG. 4 is a rear elevational view of the apparatus shown in FIG. 1.
Figure 6:
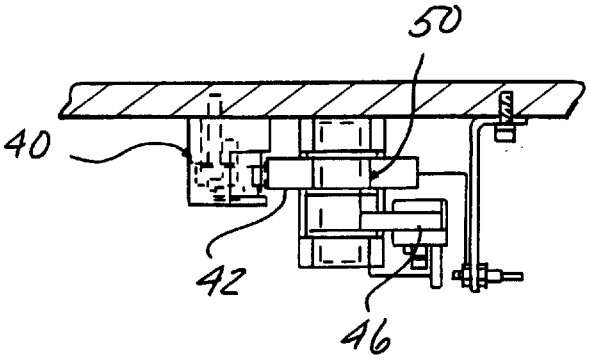
FIG. 6 is a view of a portion of the apparatus of FIG. 1 from the direction of the arrows 6—6 in FIG. 1.

The strip 28 is fed down against an inclined recessed surface of a friction block 40, with an indexing wheel 42 engaging the strip 28 pressed against the friction block 40 so as to enable advancing of a fresh strip segment into the space between the guide blocks 32A, 32B for the coating of each glazing panel part 12. Indexing of the wheel 42 is carried out by operation of a cylinder 44 mounted on a pivot support 45 and acting through a lever 46 connected to a cylinder rod clevis 43 to oscillate the wheel 42, which is mounted on a one-way clutch hub 50 to produce unidirectional incremental advance of the wheel 42 and strip 28 (FIG. 5). Fiber optic pickups 51A, 51B are mounted to monitor the position of lever 46 and an adjustable stop 53 sets the fully advanced stroke position.

A deflector element 52 is also provided comprised of a relatively thick plate having an upper end surface 54 extending in a direction across the space between the guide blocks 32A, 32B. The deflector element 52 is mounted to be vertically movable, urged in an upward direction by a fluid pressure cylinder 56 which has an output rod 58 driving the element 52 by mounting bracket 60.

As seen in FIG. 1A, the left hand guide block 32A is attached to the left hand slider 36A by means of a vertically extending mounting plate 62. The left hand slider 36A has a pair of output shafts 64 connected to an adapter 66 which is in turn attached to one side of the mounting plate 62 as shown. The mounting plate 62 has a key portion 65 which is fit into a corresponding recess in the abutting side of the guide block 32A and secured with recessed screws as shown.

Figure 7:
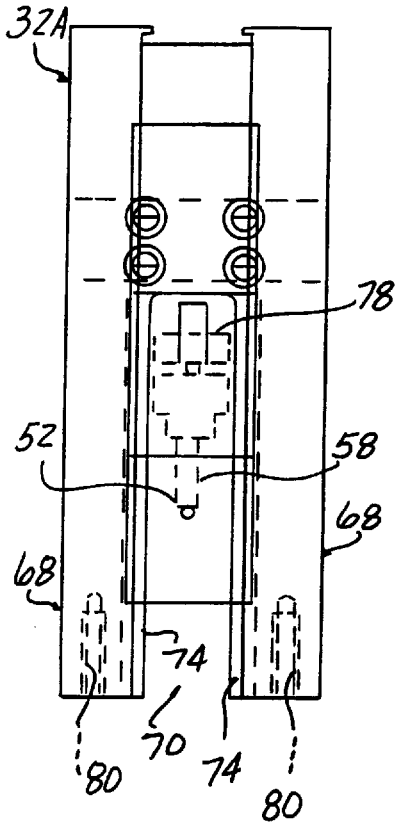
FIG. 7 is a front elevational view of a deflector element shown in FIG. 1.
Figure 8:
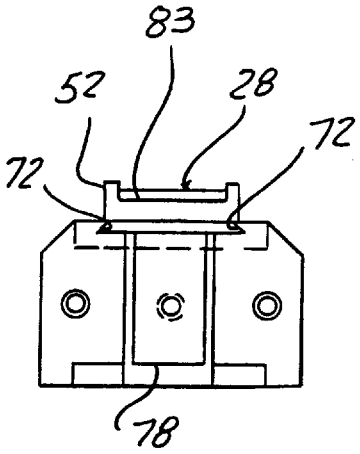
FIG. 8 is an bottom view of the deflector element and guide block shown in FIG. 7.

As seen in FIG. 7, the left hand guide block 32A has a pair of vertical legs 68 spaced apart to form a clearance channel 70 along which the deflector element 52 moves.

The deflector element 52 is generally rectangular and has a pair of dovetail edges 72 formed thereon which are received in ways 74 formed on each leg 68 so as to retain and guide the deflector element 52 in its up and down movement. An attachment rod 78 extends into the space 70, which is connected to the cylinder rod 58 as shown in FIG. 1A.

The air cylinder 58 is attached to the ends of legs 68 by screws received in tapped holes 80.

The deflector element 52 has a surface recess 83 to receive the strip 28.

Since the left side slide 36A supports the deflector element, it is of heavier construction than the right side slide.

Thus, as the robot manipulator 14 inserts the glazing panel 12 downward into the space between the guide blocks 32A, 32B to a predetermined depth, the deflector element 52 is lowered to a corresponding extent.

Figure 1B:
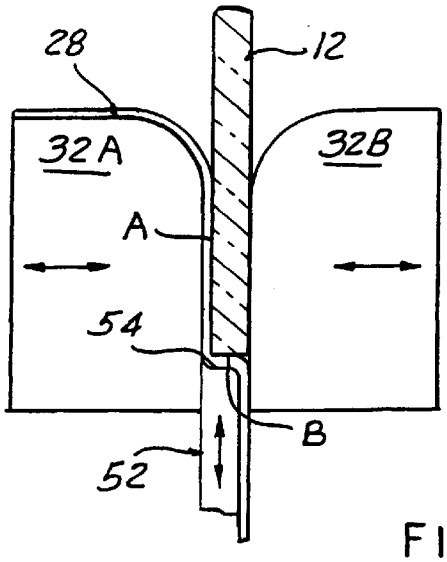
FIG. 1B is a diagram of the coating process being carried out on a part.
Figure 3:
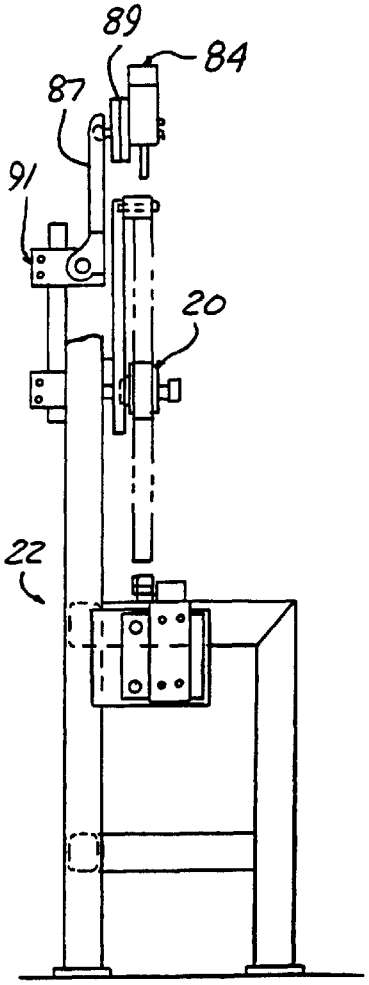
FIG. 3 is a side elevational view of the apparatus shown in FIG. 1.

Thus, as shown in FIG. 1B, as the part 12 moves into the space between the guide blocks 32A, 32B, the felt strip 28 is pushed against the adjacent face of the left guide block 32A.

The left side of the part 12 is brought into contact with the strip 28 in correspondence to the depth of penetration into the space between the guide blocks 32A, 32B. As the part is swept along in a direction parallel to the inserted edge and successively along each segment of its perimeter, the area "A" (FIG. 1B) is coated as the guide blocks 32A, 32B create a rubbing pressure by the inward pressure created by the slides 36A, 36B.

The surface "B" of the bottom edge of the part 12 also forces the strip 28 against the surface 54, forming a shoulder or step in the strip 28. The upward pressure generated by cylinder 56 creates a rubbing pressure on the perimeter edge of surface "B", so that this surface is also coated simultaneously with side area "A".

The depth of the area "A" is controlled by the depth to which the part 12 is inserted by the manipulator 14.

It will be understood by those skilled in the art that each of the slides 36A, 36B and air cylinder 56 are supplied from a suitable air supply circuit 82.

A coating dispenser 84, of a commercially available type, is supported on arm 87 and switched 89 carried by bracket 91 mounted to the fame 22, which drips primer onto the felt strip 28 in the well known manner. A primer supply reservoir 85 feeds the dispenser 84 in the well known manner.

A photoelectric monitor 86 is mounted on support 88 opposite a reflector 90 to allow detection of the primer drip to insure proper operation.

A similar monitor (not shown) can be provided to inspect the part 12 to insure that a proper coating has been applied in the well known manner.

Figure 9A:
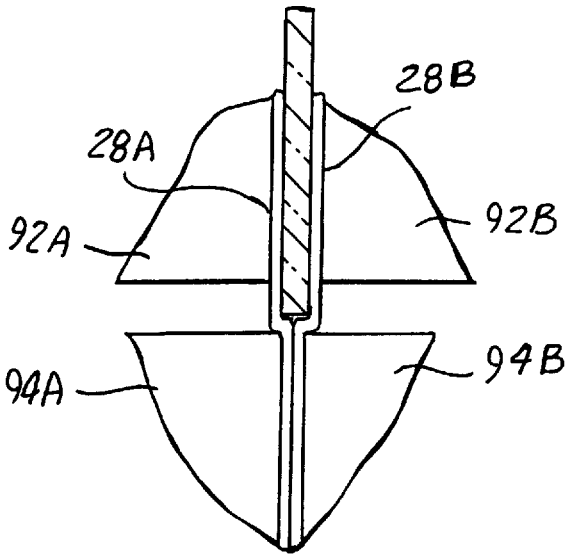
FIG. 9A is a diagram of the strips and guides during coating operations with the second embodiment.
Figure 9:
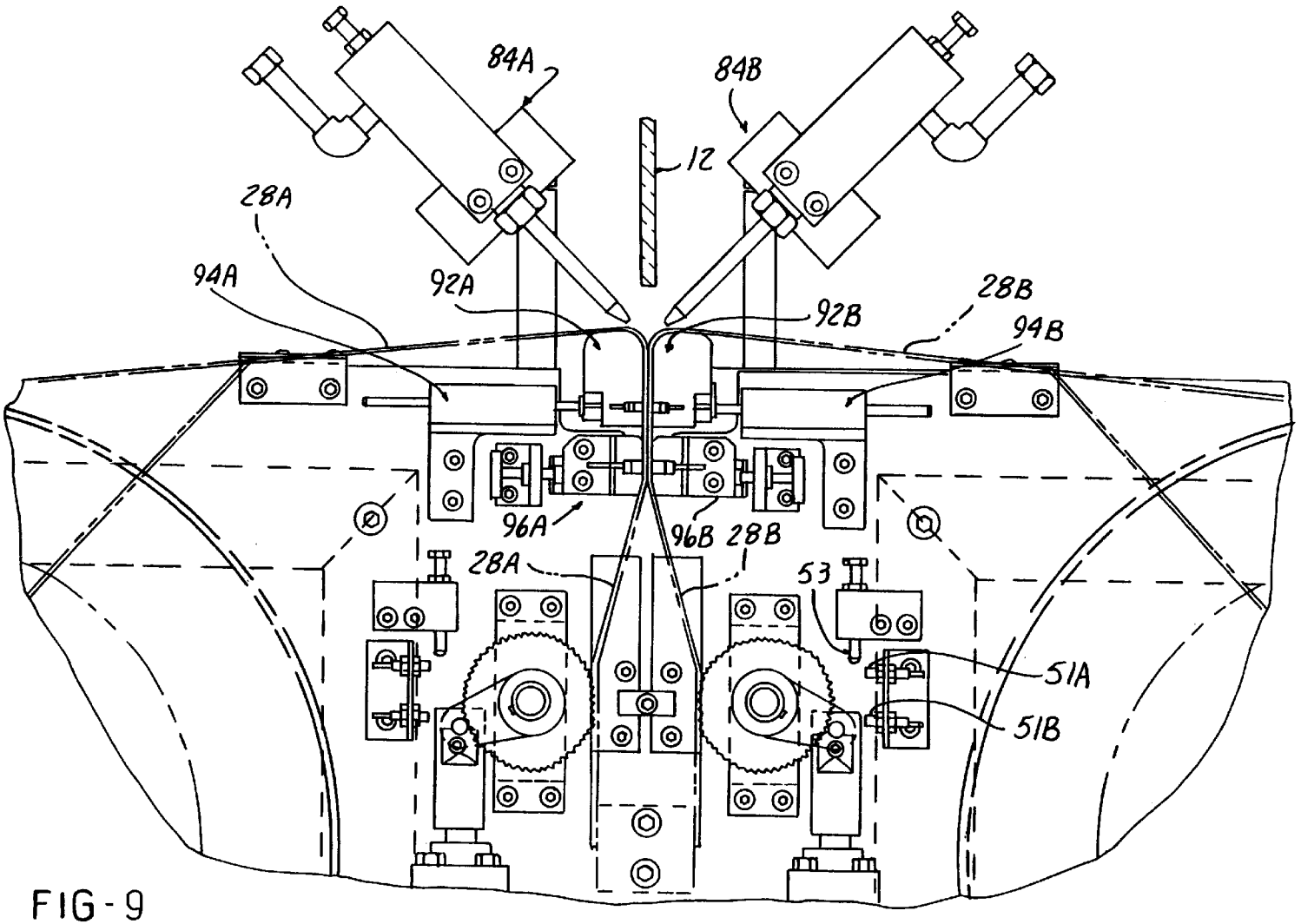
FIG. 9 is a front elevational view of a second embodiment according to the present invention.

FIG. 9 shows an arrangement in which two felt strips 28A, 28B are introduced between two identical guide blocks 92A, 92B movable apart against the resistance of identical air pressure operated slides 94A, 94B.

A pair of spaced apart fixed deflector elements 96A, 96B are positioned below the guide blocks 92A, 92B. The gap between the fixed deflector elements 96A, 96B can be adjusted during setup to just confine the strips 28A, 28B together. Thus, as shown in FIG. 9A, a shoulder or offset is created in each strip 28A, 28B by the bottom surface of the glass panel part 12, causing the edge surface to be coated simultaneously with both side surfaces of the part adjacent the edge.

I claim:

1. An apparatus for applying a wipe coating material to perimeter edge surfaces of a part extending at an angle to side edges of said part, said apparatus comprising:

a machine frame;

two aligned guide blocks, each having a guide surface facing the guide surface of the opposite guide block, said guide blocks movably mounted on slide means supported by said machine frame to allow said facing guide surfaces to move toward and away from each other, said slide means including bias means resiliently urging relative movement of said guide blocks towards each other;

a deflector element interposed between said guide blocks and having an end surface extending orthogonally in a direction across a space between said guide surfaces to form a step with one of said guide block guide surfaces;

an elongated flexible wiper strip separate from said deflector element extending through said space between said guide surfaces and movable past said deflector element;

dispensing means for said coating material positioned adjacent said guide blocks and directing said coating material so as to cause said wiper strip to be soaked with said coating material to allow a coating thereof to be wiped onto said part surfaces when said part is inserted between said guide blocks with a section of said side surface against one of said guide block surfaces with a first segment of said wiper strip interposed and a section of said perimeter edge surface urged against said deflector element with a second segment of said wiper strip interposed, said second segment thereby formed into a step shape by engagement of said perimeter edge surface to be in conformity with said side and edge surfaces of said part; and, index feed means for periodically advancing a fresh length of said strip from a supply thereon into said space between said guide surfaces.

2. The apparatus according to claim 1 further including means for mounting said deflector element to be movable into the space between said guide surfaces, and means resiliently urging said deflector element to move into said space, whereby the distance said part is pushed into said space causes said deflector element to correspondingly be moved to establish a corresponding depth of said side surfaces to be wiped against said first segment of said wiper strip.

3. The apparatus according to claim 1 wherein said deflector element is fixed below said guide blocks.

4. The apparatus according to claim 1 wherein said wiper strip is wrapped around a rounded entrance portion of one of said guide blocks in passing into said space between said guide blocks.

5. The apparatus according to claim 1 wherein said bias means urging said guide blocks towards each other comprises means for exerting regulated fluid pressure on each guide block.

6. The apparatus according to claim 1 further including a second wiper strip passing into said space between said guide blocks and a second deflector element extending in a direction across said space, said second wiper strip extending past said second deflector element, whereby two opposite sides of said part adjacent said perimeter edge surface are simultaneously wiped by being swept past said respective wiper strips.

7. The apparatus according to claim 1 wherein said supply comprises a supply reel capable of having several lengths of said wiper strip wound thereon.

8. The apparatus according to claim 2 wherein said means for resiliently urging said deflector element comprises a fluid pressure cylinder exerting a fluid pressure tending to move said deflector element into said space between said facing guide block surfaces.

* * * * *